US007424250B2

(12) United States Patent
Markovics et al.

(10) Patent No.: US 7,424,250 B2
(45) Date of Patent: Sep. 9, 2008

(54) METHODS AND DEVICES FOR REMOVING LATENT IMAGE GHOSTS PHOTORECEPTORS

(75) Inventors: James M. Markovics, Rochester, NY (US); Marc John Livecchi, Rochester, NY (US); Edward Charles Savage, Webster, NY (US); Gary Allan Batt, Fairport, NY (US); Markus Rudolf Silvestri, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 169 days.

(21) Appl. No.: 11/319,171

(22) Filed: Dec. 28, 2005

(65) Prior Publication Data

US 2007/0147864 A1 Jun. 28, 2007

(51) Int. Cl.
*G03G 15/02* (2006.01)
*G03G 21/06* (2006.01)

(52) U.S. Cl. ..... 399/128; 399/50

(58) Field of Classification Search ..... 399/50, 399/128, 129, 46, 148, 343
See application file for complete search history.

(56) References Cited

U.S. PATENT DOCUMENTS 5,771,422 A * 6/1998 Morihara ..... 399/50
5,815,776 A * 9/1998 Nukada ..... 399/174
6,223,011 B1 * 4/2001 Abramsohn et al. ..... 399/128
6,233,416 B1 * 5/2001 Kinosita et al. ..... 399/128
6,332,064 B1 * 12/2001 Sato et al. ..... 399/50
6,847,797 B2 * 1/2005 Nishihama et al. ..... 399/128 X
2002/0031371 A1 * 3/2002 Inoue ..... 399/128
2003/0123902 A1 * 7/2003 Wagner et al. ..... 399/128

* cited by examiner

*Primary Examiner*—Sophia S Chen
(74) *Attorney, Agent, or Firm*—Oliff & Berridge, PLC

(57) ABSTRACT

A ghost removing device for a marking apparatus includes a photoreceptor, a primary charging device, an erase light generating device to generate an erase light when activated, a voltage source to supply a charge voltage to the primary charging device, and a controller configured to control the at least one voltage source to supply the charge voltage to the primary charging device and to activate the erase light generating device substantially simultaneously after transfer of a toned image within a marking cycle. A ghost removing method for a marking device with a photoreceptor, including performing a partial print cycle, applying an erase light to the photoreceptor, and applying a charge voltage to the photoreceptor, wherein the erase light and the charge voltage are applied to the photoreceptor substantially simultaneously after completion of the partial cycle.

14 Claims, 3 Drawing Sheets

METHODS AND DEVICES FOR REMOVING LATENT IMAGE GHOSTS PHOTORECEPTORS

BACKGROUND

Latent image ghosting in photoreceptors is a common problem. Such ghosts have generally been identified as resulting either directly from image-wise exposure or from different amounts of positive charge injected in non-toned and toned image areas. Both result in an arrangement of trapped positive charges that release during re-charging on a subsequent cycle, leading to a pattern of differential charge level that manifests itself in subsequent prints as an image-wise pattern of development, or ghost, of a prior image cycle. Massive erase light is conventionally used to flood the image-wise exposed photoreceptor to remove trapped charges. Such methods generally help, but sometimes prove to be insufficient to suppress ghosting.

The photo-discharge resulting from the erase light, often one or two orders of magnitude greater than the largest exposure utilized during the exposure step of the printing cycle, is always greater when following an image exposure than that observed had the image exposure not preceded the erase, and the magnitude of the increased erase discharge increases with increasing image exposure. One reason for this phenomenon is that not all charge pairs that are photo-generated during image exposure separate, release, and transport out of the photoreceptor layers prior to the erase step. Some portion of these remaining nascent charge pairs is released and transported over time following the initial rapid discharge. These charges are the "delayed release" charges, and manifest themselves as increased dark decay of partially discharged photoreceptors. The remaining portion of these nascent charge pairs continue to be released during the period prior to erase and, depending on their distribution within the generator layer, may contribute to an enhanced local field within the generator, thus augmenting the erase-photogenerated charge yield, resulting in the observed enhanced erase discharge following exposure.

Depending on the physical distribution within the generator layer of these subsequently erase-generated charge pairs, an image-wise population of nascent charges may persist after the first ghost generation cycle charge step, during which they release under the charging field, appearing as increased "depletion" charge, or dark decay, leading to lower charge potential in an image-wise sense. Whether this increased depletion results in positive or negative ghosting depends significantly on the rate of delayed release, the time between exposure and erase, and on the time between erase and charge. If the number density of erase-generated charge in the background is comparable with the image areas, then ghosting may be suppressed. This has traditionally been the rationale behind "flood erase" to suppress image ghosting, in order to minimize the difference in dark decay or depletion between image and background areas going into the first ghost generation. Unfortunately, this traditional approach to suppressing image ghosting has limited success.

SUMMARY

To aid in understanding both the mechanism and the phenomenology of ghosting, the original image is referred to as a generation "0" image, or the first exposure, development, and transfer of the original image on a rested or "virgin" photoreceptor. Also, the first ghost generation is part of a subsequent imaging event that utilizes the same physical part of the photoreceptor as the original image. Thus, the first ghost generation is the second xerographic cycle. This first generation ghost may appear on the same or a subsequent print, depending on how many xerographic cycles are required to image one print. Similarly, one can describe second and multiple generation ghost images.

Often, in order to print a latent ghost image, the generation print must itself have some structured image other than background. Thus, mid-density half-tones are used as test images. In such mid-density half-tones, the ghost of an original image that appears darker than its surrounding medium is identified as a "positive ghost," and as a "negative ghost" if it appears lighter than its surrounding medium. Consequently, only positive ghosts can print in background areas as first generation ghosts if the background is devoid of toner. Positive ghosts generally result from the image-wise release of trapped positive charge remaining after image-wise exposure following the charge step in the first ghost generation. These charges might be more deeply trapped delayed release photogenerated charges, or simply deeply trapped holes not adequately compensated by negative charges generated during the erase step.

On the other hand, transfer-induced negative ghosting results from the release of trapped injected positive charge during the first ghost generation charging step. The image-wise developed toner blocks the injection of positive charges applied during the transfer step of the original image cycle, resulting in more trapped injected positive charge in the background compared with the exposed areas of the original image cycle. During the charging step of the first ghost generation cycle, the original background areas both charge and discharge at a lower voltage than original image areas, resulting in a negative ghost of the original image embedded in a half-tone surrounding medium.

In light of the above-discussed problems, various exemplary embodiments effectively neutralize the trapped positive charges associated with the latent image ghost by flooding the photoreceptor with sufficient electron-hole pairs to compensate for the trapped positive charges with free electrons, while simultaneously providing an electric field of sufficient strength to sweep out the free holes released by the electrons used in the compensation. This goal is achieved by arranging for the erase exposure and the negative charging to occur simultaneously, or sufficiently close to one another, such that the charge pairs that are subject to delayed release are sufficient to provide compensation for the ghost-trapped positive charges.

Various exemplary embodiments provide a ghost removing device for a marking apparatus that includes a photoreceptor, a primary charging device, an erase light generating device configured to generate an erase light when activated, at least one voltage source configured to supply a charge voltage to the primary charging device, and at least one controller configured to control the at least one voltage source to supply the charge voltage to the primary charging device and to activate the erase light generating device substantially simultaneously after transfer of a toned image within a marking cycle.

Various exemplary embodiments also provide a ghost removing method for a marking device with a photoreceptor, that includes performing a partial print cycle, applying an erase light to the photoreceptor via an erase light generating device, and applying a charge voltage to the photoreceptor via a charging device, wherein the erase light and the charge voltage are applied to the photoreceptor substantially simultaneously after completion of the partial print cycle.

Finally, various exemplary embodiments provide a xerographic device with a photoreceptor, means for performing a partial print cycle, means for applying an erase light to the photoreceptor via an erase light generating device, and means for applying a charge voltage to the photoreceptor via a charging device, wherein the erase light and the charge voltage are applied to the photoreceptor substantially simultaneously after completion of the partial print cycle.

It should be noted that the operating principles described herein also apply to other charging systems as well, such as BCR (Bias Charge Roll), whether in contact with a photoreceptor or not, and, for example, other charging devices such as the "microtron," or the "dicorotron".

BRIEF DESCRIPTION OF THE DRAWINGS

Various exemplary embodiments of systems and methods will be described in detail, with reference to the following figures, wherein.

DETAILED DESCRIPTION OF EMBODIMENTS

These and other features and advantages of this invention are described in, or are apparent from, the following detailed description of various exemplary embodiments of systems and methods.

The xerographic cycle is well recognized as comprising several steps, with the photoreceptor playing the central role of latent image-bearing member. These steps are i) charging, wherein one sign of charge is applied to the photoreceptor; ii) image-wise exposure, wherein an image wise pattern of light exposes and photo-discharges the photoreceptor; iii) development, wherein charged toner particles are presented to adhere to the discharged areas of the photoreceptor; iv) transfer, wherein an opposite signed charge is applied to the rear surface of a substrate to move the developed toner while retaining the image-wise pattern to the receiving substrate; v) detack, wherein some charge is applied to the substrate to facilitate stripping of the substrate from the photoreceptor; and vi) erase and cleaning, wherein the photoreceptor is flood exposed to uniformly discharge, and remove any residual toner from the photoreceptor prior to resuming the cycle with step i).

Figure 1:
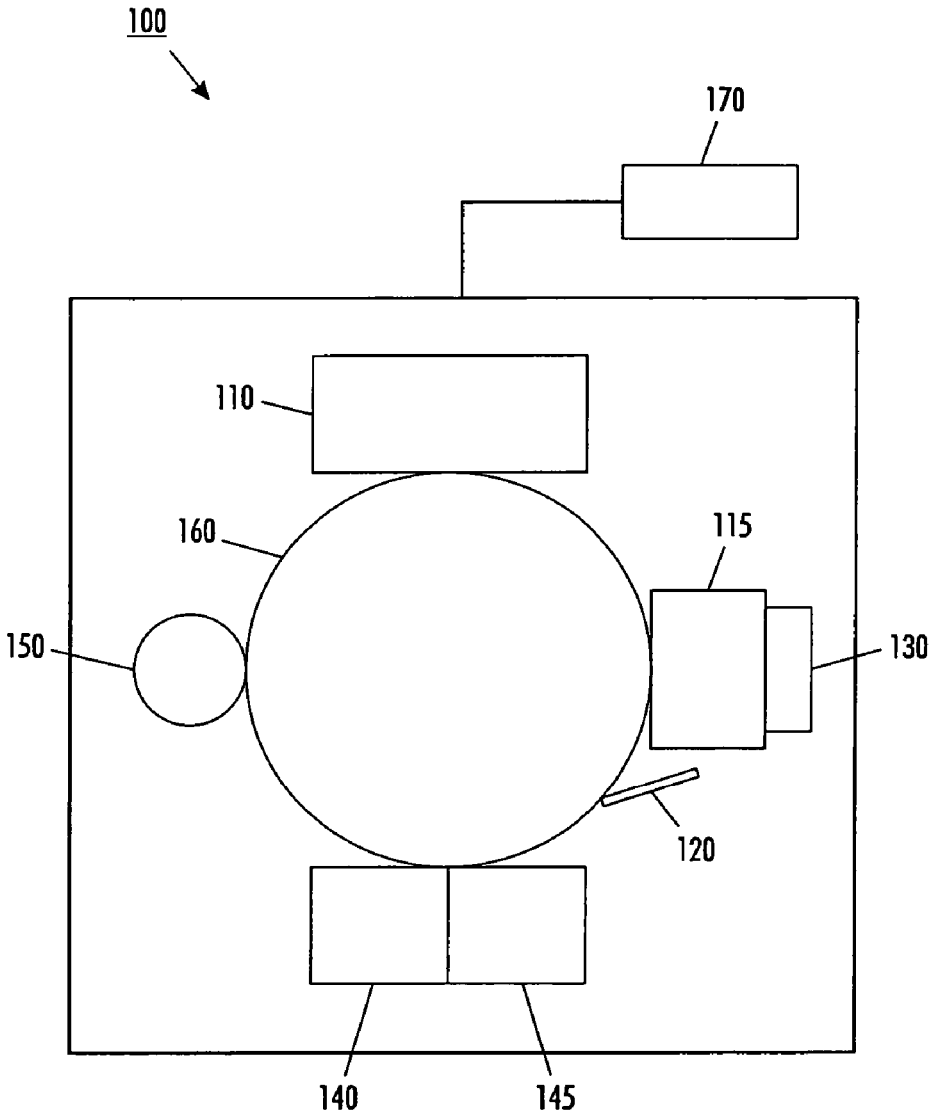
FIG. 1 is an illustration of an exemplary ghost removing device.

FIG. 1 is an illustration of an exemplary ghost removing device. In FIG. 1, a marking device 100 that includes a photoreceptor 160, a cleaning device 120, a developer 150, a transfer 140, detack 145, and two charging devices 110 and 115 such as, for example, scorotrons, also includes a controller 170 and an erase light generating device such as, for example, an erase lamp 130. According to various exemplary embodiments, the erase light generating device 130 is located over the scorotron 115 such that the scorotron 115 is sandwiched between the erase light generating device 130 and the photoreceptor 160. According to various exemplary embodiments, the controller 170 controls the two scorotrons 110 and 115, the photoreceptor 160 and the erase light from the erase light generating device 130 mounted in the marking device 100 so that the erase light generating device 130 shines through the grid of the scorotron 115 and onto the photoreceptor 160. It should be noted that each of the scorotrons 110 and 115 may be replaced by a corotron or other charging device such as, for example, a BCR, a microtron or a dicotron. According to various exemplary embodiments, the erase light generating device may be replaced by any device that is capable of providing an erase light when activated.

According to various exemplary embodiments, the controller 170 controls a charge being applied to the photoreceptor 160 by the scorotron 110, then an image-wise pattern of light exposes and photo-discharges the photoreceptor 160. Subsequently, charged toner particles are provided to adhere to the discharged areas of the photoreceptor 160, then the controller 170 controls the application of a charge, with a sign opposite to the charge applied to the photoreceptor 160, to the receiving substrate at the transfer device 140 to remove the developed toner while retaining the image-wise pattern, and some additional charge is applied via the detack 145 to the substrate to facilitate stripping of the substrate from the photoreceptor 160. The photoreceptor 160 is then flood-exposed to uniformly discharge by an erase light generating device 130, and the cleaning device 120 removes any residual toner from the photoreceptor 160 prior to resuming another print cycle. According to various exemplary embodiments, the erase light generated by the erase light generating device 130 and controlled by the controller 170 shines through the scorotron 115 to reach the photoreceptor 160, and the charge voltage applied to the scorotron 115 is applied simultaneously or near-simultaneously with the erase light generated by the erase light generating device 130. Also, the controller 170 may control any device for supplying an erase light, and may control any device for supplying a charge voltage to the scorotrons 110 and 115.

Various exemplary embodiments combine a higher field with the erase generated charges, and positive charges are swept out more efficiently, leaving negative erase-generated charges to compensate for any deeply trapped positive charges remaining on the photoreceptor 160 due either to image-wise exposure or to transfer charge injection in background areas. Furthermore, by discharging and charging near simultaneously, the image-wise structure of residual charge pairs, either those destined for delayed release or those more deeply trapped, is removed. In other words, by combining erase light and simultaneous charging, electron-hole pairs are generated in the generator layer of the photoreceptor in such an amount that the trapped charges are compensated, and any excess charge carriers are swept out such as to make spatially uniform any residual charge distribution that may remain on the photoreceptor 160.

For example, using a photoreceptor with a known history of severe ghosting as large as, for example, Grade 5 on a scale of 0 to 5, where 0 is no observed ghost, and 5 is the worst, strong transfer ghosting is observed with no current applied to the scorotron 115. With a voltage of about −4.5 KV applied to the scorotron 115 and −500 V applied to the screen of the scorotron 115, the ghost grade drops to Grade 0. In subsequent operation, ghosting can be made to appear or disappear simply by turning the scorotron off or on, respectively. Table 1 illustrates the exposure of a detector diode located under the erase light generating device 130 in this exemplary embodiment. In Table 1, various measurements of exposure under the erase light generating device 130 are reported.

It should be noted that neither the positive charge from the scorotron, nor the negative charge without erase present, has an effect in reducing the ghost signal. In fact, positive charge with the erase light generating device 130 on results in darker prints and a stronger ghost grade. Also, applying a negative charge alone from the scorotron 115 without energizing the erase light 130 has no measurable effect on the strength of the ghost. Accordingly, simultaneous or near simultaneous charge and exposure is required to eliminate the ghost.

According to various exemplary embodiments, the erase light generating device 130 may be an erase lamp.

TABLE 1

Measurement of Exposure under the Erase Lamp

| Erase Lamp Voltage | Detector Diode [ua] | Exposure [erg/cm^2] |
|---|---|---|
| 12.5 | 0.56 | 1.6 |
| 13 | 2.31 | 6.5 |
| 14 | 9.45 | 27 |
| 15 | 20.6 | 58 |
| 16 | 31.14 | 88 |
| 17 | 43.12 | 122 |
| 18 | 53.6 | 152 |
| 19 | 64.31 | 182 |
| 20 | 74.46 | 211 |

Figure 2:
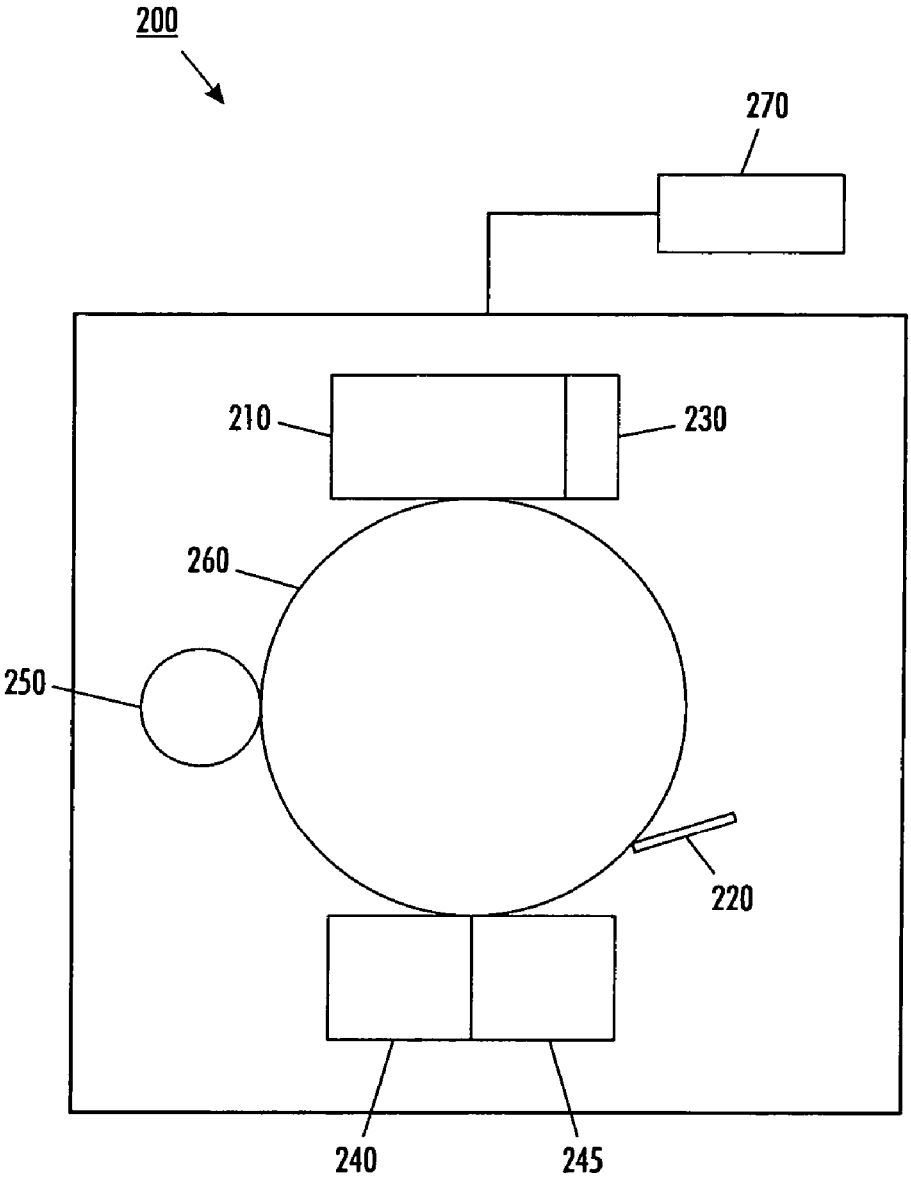
FIG. 2 is an illustration of an exemplary ghost removing device.

FIG. 2 is an illustration of another exemplary ghost removing device. In FIG. 2, a marking device 200 includes a controller 270, cleaning device 220, a developer 250, a transfer 240 detack 245, and an erase light generating device 230 located adjacent to a charging device such as, for example, a scorotron 210. According to various exemplary embodiments, the controller 270 controls the application of a charge to the photoreceptor 260 via the scorotron 210, then an image-wise pattern of light exposes and photo-discharges the photoreceptor 260. Subsequently, charged toner particles are presented to adhere to the discharged areas of the photoreceptor 260, then the controller 270 controls the application of a charge via the transfer 240, with a sign opposite to the charge applied to the photoreceptor 260, to move the developed toner while retaining the image-wise pattern to the receiving substrate, and some additional charge is then applied via the detack 245 to the substrate to facilitate stripping of the substrate from the photoreceptor 260. Then, in the xerographic cycle, residual toner may be removed from the photoreceptor 260 at the cleaning station 220. The photoreceptor 260 is then flood-exposed under control of the controller 270 to uniformly discharge by the exposure to erase light generated by the erase light generating device 230 that is located adjacent to the scorotron 210, prior to resuming another print cycle. Simultaneously or near-simultaneously with the application of the erase light by the erase light generating device 230, a charge voltage is applied under control of the controller 270 to the scorotron 210 in order to compensate for positive trapped charge and sweep out any excess photogenerated charge more efficiently. According to various exemplary embodiments, the erase light generating device 230 may be, for example, an erase lamp.

Table 2 illustrates the exposure of a detector diode located under the scorotron 210 in this exemplary embodiment. In Table 2, the erase lamp voltages that produce the best ghost suppression in this illustrated example are voltages of 13.2-13.6 V, resulting in erase light exposures of 0.5-0.9 erg/cm$^2$, respectively. In other exemplary cases, where the erase light is located apart from the scorotron, but where the photoreceptor is exposed through a second charging device 115, the ghost signal can be suppressed using a low value of erase exposure such as, for example, approximately 10% of the normal erase energy of 80 erg/cm$^2$, or about 8 erg/cm$^2$. Measurements of flare light under the scorotron 210 shows a very low exposure, of about 0.8 erg/cm$^2$. Under these conditions, prints generally appear ghost free and of good print quality, despite the absence of a strong erase in the usual pre-clean position. In other words, according to various exemplary embodiments, some erase light is combined with some charging just prior to the primary charge action. Thus, the effect of this combination of erase light with some charge is also a photogeneration of compensating charge and efficient sweep out of any excess photo-generated carriers from the photoreceptor.

TABLE 2

Measurement of Exposure under the Primary Charge Scorotron

| Erase Lamp Voltage | Detector Diode [ua] | Exposure [erg/cm^2] |
|---|---|---|
| 12 | 0 | 0.0 |
| 12.5 | 0.02 | 0.1 |
| 13 | 0.1 | 0.3 |
| 13.2 | 0.17 | 0.5 |
| 13.3 | 0.19 | 0.5 |
| 13.4 | 0.26 | 0.7 |
| 13.5 | 0.29 | 0.8 |
| 13.6 | 0.31 | 0.9 |
| 13.7 | 0.36 | 1.0 |
| 13.8 | 0.4 | 1.1 |
| 13.9 | 0.45 | 1.3 |
| 14 | 0.52 | 1.5 |

The above-described examples suggest that the mechanism by which the positive charge-induced negative ghosting is suppressed involves the generation and sweeping out of holes in the photoreceptor in such density as to provide adequate negative counter charge in the photoreceptor to compensate for the trapped holes that underlie the ghost phenomenon. In the example illustrated in FIG. 1, the generation and sweep out occurs at a different time than the re-charging of the photoreceptor. In the example illustrated in FIG. 2, the generation and sweep out occurs as part of the re-charging process, partly due to the flare light under the scorotron 210 and partly from the adjacent pre-charge exposure.

Figure 3:
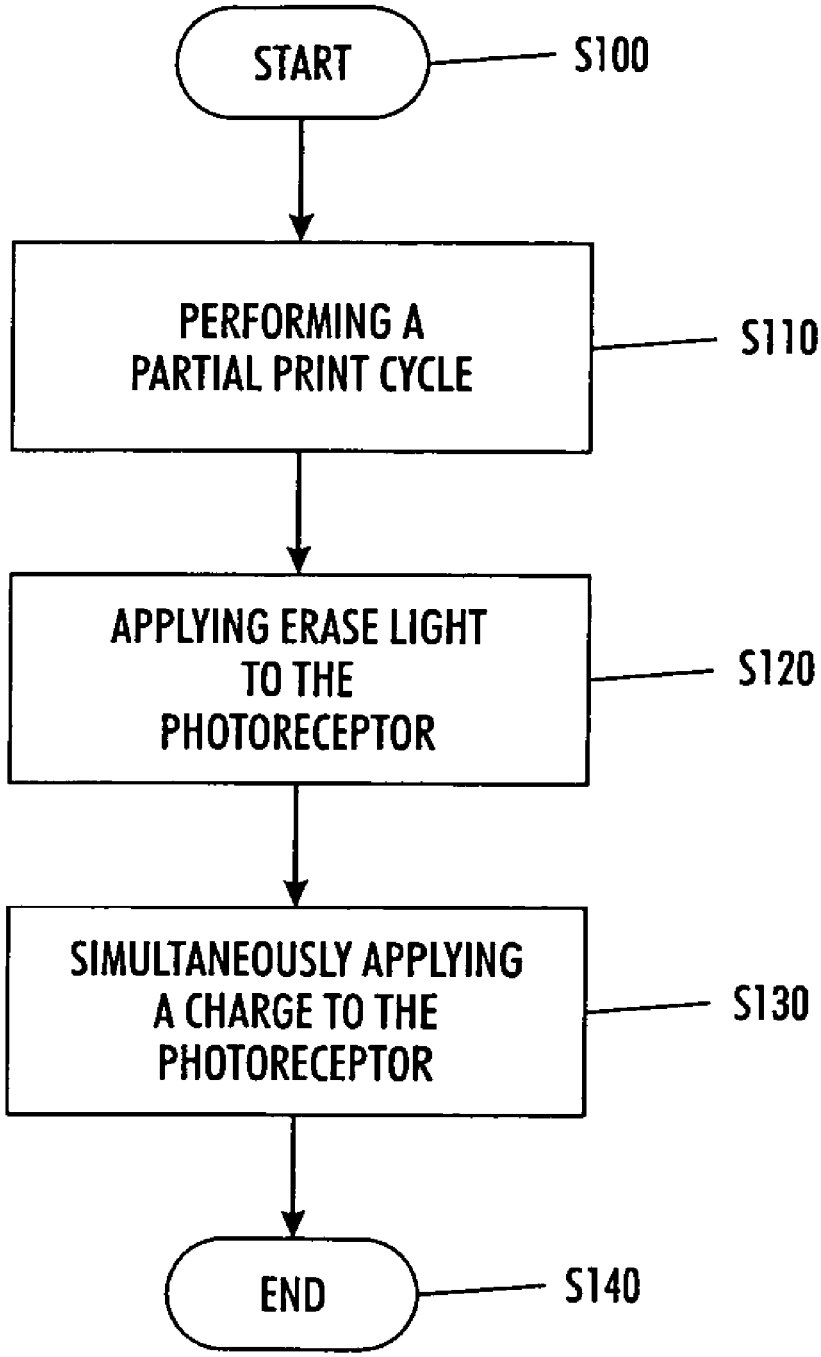
FIG. 3 is a flow chart illustrating an exemplary ghost removing method.

FIG. 3 is a flow chart illustrating an exemplary ghost removing method. In FIG. 3, the method starts in step S100, and continues to step S110, during which a partial print cycle is performed in a marking device. According to various exemplary embodiments, the partial print cycle includes charge of the photoreceptor, image-wise exposed, image-wise development, and toned image transfer. The partial print cycle may also include cleaning of the photoreceptor by a cleaning device after toned image transfer. According to various exemplary embodiments, the charging of the photoreceptor during step S110 is performed using a primary charging device such as, for example, a scorotron, a corotron, a BCR, or a dicotron. Next, control continues to step S120, during which an erase light, provided by an erase light generating device, is applied to the photoreceptor. According to various exemplary embodiments, the erase light generating device such as, for example, an erase lamp, may be provided over a secondary charging device, such as a scorotron, such that the secondary charging device is sandwiched between the erase lamp and the photoreceptor. According to various exemplary embodiments, the erase light applied to the photoreceptor via the erase lamp uniformly discharges the photoreceptor.

Moreover, according to other exemplary embodiments, the erase lamp may be provided adjacent to the primary charging device, over the photoreceptor, and is sufficiently close to the primary charging device to allow some erase exposure to take place simultaneously or near-simultaneously to the charging applied by the primary charging device without completely filling the primary charging device with erase light. In this case, the erase light exposes only a small fraction of the primary charging device.

Next, control continues to step S130, during which a charge voltage is applied to the photoreceptor via the secondary charging device of the marking device. According to various exemplary embodiments, the charge voltage creates an electric field that sweeps out any remaining positive trapped charges from the photoreceptor more efficiently. During step S130, the charge voltage applied to the photoreceptor by the secondary charging device is applied simultaneously or near simultaneously to the erase exposure applied during step S120. According to various exemplary embodiments, the charge voltage applied by the secondary charging device during step S130 is comparable in value to, and of the same sign as, the charge applied to the photoreceptor by the primary charging device during step S110. Thus, ghost removal is achieved when the erase light is applied during step S120 and then the charge voltage is applied to the photoreceptor by the secondary charging device during step S130 simultaneously or near-simultaneously to the application of the erase light. Next, control continues to step S140, where method ends.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A ghost removing device for a marking apparatus comprising:

a photoreceptor;

a single charging device;

an erase light generating device configured to generate an erase light when activated; and a single controller configured to control a substantially simultaneous charging of the photoreceptor by the charging device and activation of the erase light generating device after transfer of a toned image within a marking cycle, thereby substantially eliminating trapped charges prior to a commencement of all successive marking cycles following a first marking cycle on the photoreceptor, and resulting in no visible ghosting;

wherein:

the charging device is adjacent to the erase light generating device;

the charging device applies a negative direct current; and the erase light generating device emits energy between 0.1 erg/cm$^2$ to 1.5 erg/cm$^2$.

2. The device of claim 1, wherein the charging device comprises at least one of a scorotron, a corotron, a bias charge roll and a dicotron.

3. The device of claim 1, wherein the erase light generating device comprises an erase lamp.

4. The device of claim 1, wherein the erase light generating device emits energy between 0.5 erg/cm$^2$ to 0.9 erg/cm$^2$.

5. A method of removing ghost images formed by a marking device comprising a photoreceptor, the method comprising:

performing a partial marking cycle;

applying an erase light to the photoreceptor via an erase light generating device; and applying a charge voltage to the photoreceptor via a charging device;

wherein:

a single controller controls both application of the erase light to the photoreceptor via an erase light generating device and application of a charge voltage to the photoreceptor; and the erase light and the charge voltage are applied to the photoreceptor substantially simultaneously after completion of the partial marking cycle, thereby substantially eliminating trapped charges prior to a commencement of all successive marking cycles following a first marking cycle on the photoreceptor, and resulting in no visible ghosting;

wherein:

the charging device is adjacent to the erase light generating device;

the charging device applies a negative direct current; and the erase light generating device emits energy between 0.1 erg/cm$^2$ to 1.5 erg/cm$^2$.

6. The method of claim 5, wherein performing the partial marking cycle comprises:

applying a charge voltage via the charging device;

performing image-wise exposing;

performing image-wise development; and performing transfer of a toned image.

7. The method of claim 6, wherein performing the partial marking cycle further comprises cleaning a residue toner from the photoreceptor with a cleaning device.

8. The method of claim 6, wherein applying an erase light to the photoreceptor via an erase light generating device comprises applying an erase light via an erase lamp located adjacent to the charging device.

9. The method of claim 5, wherein the erase light generating device emits energy between 0.5 erg/cm$^2$ to 0.9 erg/cm$^2$.

10. A xerographic device that includes a photoreceptor, comprising:

means for performing a partial print cycle;

means for applying an erase light to the photoreceptor via an erase light gene rating device; and means for applying a charge voltage to the photoreceptor via a single charging device;

wherein:

a controller is configured to control both the application of the erase light to the photoreceptor via an erase light generating device and the application of a charge voltage to the photoreceptor via the charging device;

the erase light and the charge voltage are applied to the photoreceptor substantially simultaneously after completion of the partial print cycle, thereby substantially eliminating trapped charges prior to a commencement of a successive marking cycle following a first marking cycle on the photoreceptor, and resulting in no visible ghosting;

wherein:

the charging device is adjacent to the erase light generating device;

the charging device applies a negative direct current; and the erase light generating device emits energy between 0.1 erg/cm$^2$ to 1.5 erg/cm$^2$.

11. The device of claim 10, wherein the means for performing a partial print cycle comprise a single charging device.

12. The device of claim 11, wherein the charging device comprises at least one of a scorotron, a corotron, a bias charge roll and a dicotron.

13. The device of claim 10, wherein the means for applying an erase light comprise an erase lamp.

14. The device of claim 10, wherein the erase light generating device emits energy between 0,5 erg/cm$^2$ to 0.9 erg/cm$^2$.

* * * * *